US006662564B2

(12) United States Patent
Bruck et al.

(10) Patent No.: US 6,662,564 B2
(45) Date of Patent: Dec. 16, 2003

(54) CATALYTIC COMBUSTOR COOLING TUBE VIBRATION DAMPENING DEVICE

(75) Inventors: Gerald J. Bruck, Murrysville, PA (US); Thomas E. Lippert, Murrysville, PA (US); Daniel R. Bartolomeo, Monroeville, PA (US); William E. Kepes, Trafford, PA (US); Donald M. Newburry, Broken Arrow, OK (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 110 days.

(21) Appl. No.: 09/965,557

(22) Filed: Sep. 27, 2001

(65) Prior Publication Data

US 2003/0056511 A1 Mar. 27, 2003

(51) Int. Cl.[7] ..... F23R 3/40
(52) U.S. Cl. ..... 60/723; 431/170
(58) Field of Search ..... 60/723, 725; 431/170

(56) References Cited

U.S. PATENT DOCUMENTS 3,718,426 A 2/1973 Harris
6,174,159 B1 1/2001 Smith et al.
6,415,608 B1 * 7/2002 Newburry ..... 60/723

FOREIGN PATENT DOCUMENTS

DE 1915304 10/1969

* cited by examiner

*Primary Examiner*—Louis J. Casaregola

(57) ABSTRACT

A dampening device for suppressing vibrations of a tube assembly in a catalytic combustor which includes, a plurality of closely oriented, parallel tubes with each tube having at least one expanded region and at least one narrow region. The expanded regions being structured to contact at least one adjacent tube, thus providing support and minimizing degradation of the joint connecting the tubes to the tube sheet, and degradation of the tubes themselves. Such degradation can result from vibration due to flow of cooling air inside of the tubes, flow of the fuel/air mixture passing over the tubes transverse and longitudinal to the tube bundle, and/or other system/engine vibrations.

20 Claims, 10 Drawing Sheets

CATALYTIC COMBUSTOR COOLING TUBE VIBRATION DAMPENING DEVICE

BACKGROUND OF THE INVENTION

1. Field of the Invention

This invention relates to a catalytic combustor for a combustion turbine and, more specifically, to a device for suppressing vibration in the plurality of cooling tubes which pass through the fuel/air mixture plenum within a catalytic combustor.

2. Background Information

Combustion turbines, generally, have three main assemblies: a compressor assembly, a combustor assembly, and a turbine assembly. In operation, the compressor compresses ambient air. The compressed air flows into the combustor assembly where it is mixed with a fuel. The fuel and compressed air mixture is ignited creating a heated working gas. The heated working gas is expanded through the turbine assembly. The turbine assembly includes a plurality of stationary vanes and rotating blades. The rotating blades are coupled to a central shaft. The expansion of the working gas through the turbine section forces the blades, and therefore the shaft, to rotate. The shaft may be connected to a generator.

Typically, the combustor assembly creates a working gas at a temperature between 2,500 to 2,900 degrees Fahrenheit (1371 to 1593 degrees centigrade). At high temperatures, particularly above about 1,500 degrees centigrade, the oxygen and nitrogen within the working gas combine to form the pollutants NO and $NO_2$, collectively known as NOx. The formation rate of NOx increases exponentially with flame temperature. Thus, for a given engine working gas temperature, the minimum NOx will be created by the combustor assembly when the flame is at a uniform temperature, that is, there are no hot spots in the combustor assembly. This is accomplished by premixing all of the fuel with all of the of air available for combustion (referred to as low NOx lean-premix combustion) so that the flame temperature within the combustor assembly is uniform and the NOx production is reduced.

Lean pre-mixed flames are generally less stabile than non-well-mixed flames, as the high temperature/fuel rich regions of non-well-mixed flames add to a flame's stability. One method of stabilizing lean premixed flames is to react some of the fuel/air mixture in conjunction with a catalyst prior to the combustion zone. To utilize the catalyst, a fuel/air mixture is passed over a catalyst material, or catalyst bed, causing a pre-reaction of a portion of the mixture and creating radicals which aid in stabilizing combustion at a downstream location within the combustor assembly.

Prior art catalytic combustors completely mix the fuel and the air prior to the catalyst. This provides a fuel lean mixture to the catalyst. However, with a fuel lean mixture, typical catalyst materials are not active at compressor discharge temperatures. As such, a preburner is required to heat the air prior to the catalyst adding cost and complexity to the design as well as generating NOx emissions, See e.g., U.S. Pat. No. 5,826,429. It is, therefore, desirable to have a combustor assembly that burns a fuel lean mixture, so that NOx is reduced, but passes a fuel rich mixture through the catalyst bed so that a preburner is not required. The preburner can be eliminated because the fuel rich mixture contains sufficient mixture strength, without being preheated, to activate the catalyst and create the necessary radicals to maintain a steady flame, when subjected to compressor discharge temperatures. As shown in U.S. patent application Ser. No. 09-670,035, which is incorporated by reference, this is accomplished by splitting the flow of compressed air through the combustor. One flow stream is mixed with fuel, as a fuel rich mixture, and passed over the catalyst bed. The other flow stream may be used to cool the catalyst bed.

One disadvantage of using a catalyst is that the catalyst is subject to degradation when exposed to high temperatures. High temperatures may be created by the reaction between the catalyst and the fuel, pre-ignition within the catalyst bed, and/or flashback ignition from the downstream combustion zone extending into the catalyst bed. Prior art catalyst beds included tubes. These tubes were susceptible to vibration because they were cantilevered, being connected to a tube sheet at their upstream ends. The inner surface of the tubes were free of the catalyst material and allowed a portion of the compressed air to pass, unreacted, through the tubes. The fuel/air mixture passed over the tubes, and reacted with, the catalyst. Then, the compressed air and the fuel/air mixture were combined. The compressed air absorbed heat created by the reaction of the fuel with the catalyst and/or any ignition or flashback within the catalyst bed. See U.S. patent application Ser. No. 09-670,035.

The disadvantage of such systems is susceptibility of the tubular configuration to vibration damage resulting from: (1) flow of cooling air inside of the tubes, (2) flow of the fuel/air mixture passing over the tubes transverse and longitudinal to the tube bundle, and (3) other system/engine vibrations. Such vibration has caused problems in the power generation field, including degradation of the joint (e.g. braze) connecting the tubes to the tubesheet and degradation of the tubes themselves, both resulting from tube to tube and/or tube to support structure impacting.

There is, therefore, a need for a dampening device for a catalytic reactor assembly of a combustion turbine, which suppresses vibration of the plurality of closely oriented parallel tubes.

There is further a need for a dampening device for a catalytic reactor assembly to effectively baffle and promote even distribution of the fuel/air mixture.

There is further a need for a dampening device for a catalytic reactor assembly that provides a stronger, reinforced attachment of the tubes to the tubesheet.

There is further a need for a dampening device for a catalytic reactor assembly that provides resistance to reverse flow of the fuel/air mixture caused by eddie currents, which in turn can lead to backflash (premature ignition of the fuel in the combustor).

There is further a need for a dampening device for a catalytic reactor assembly that maintains appropriate pressure differential to promote uniform distribution of the fuel/air mixture and ensure adequate cooling is maintained.

SUMMARY OF THE INVENTION

The present invention satisfies these needs, and others, by providing a dampening device with expanded regions on the tubes that maintain tube to tube contact and thus suppress vibration. The invention consists of at least one expanded region and at least one narrow region on each tube. The expanded region may be achieved by a localized increase in the nominal tube circumference, a sleeve or furrel placed over the tube and enlarging the circumference, or by machining or swaging the tube to create narrow regions. The localized expansions extend for a portion of the tube length, having a gradual transition between the nominal circumference and the center of expansion. If the tube is cut or swaged to create narrow regions in between the nominal tube circumference regions, the nominal tube circumference would serve as the expanded region. There may also be multiple expanded regions on a tube.

The expanded regions may be symmetric along the tube length and/or around the tube circumference. Alternatively, the expansions could be non-symmetric, or even single-sided. Expansions located at the ends of the tubes are examples of single-sided expansions. Moreover, an expanded region on one tube may contact another expanded region on another tube, or alternatively, may be staggered so that an expanded region on one tube contacts the narrow region of an adjacent tube. The tubes and the expanded regions thereon could be a variety of shapes such as bulges, ridges, and/or helices, so long as the flow path around the tubes and desired pressure drop is maintained.

By maintaining tube to tube contact, adjacent tubes support one another rather than impact one another during various modes of vibration. Moreover, expansion of the tubes to provide contact at a plane just downstream of the fuel/air inlet has been predicted analytically to effectively baffle and to promote even distribution of the fuel/air mixture.

The upstream ends of the tubes may be bulged or expanded to provide additional support of the fragile joints (e.g. brazes) where the tubes attach to the tube sheet. Similarly, the tubes may be bulged at their downstream ends to provide resistance to reverse flow and therefore backflash, because eddie currents are eliminated by the gradual bulging profile. The expanded or flared inlet and outlet ends of the tubes also provide a substantial reduction (e.g. approximately 14 percent for a flared inlet, 22 percent for a flared outlet) in pressure differential between the air inside the tubes and the air/fuel mixture passing over them. Avoiding an excessive pressure differential allows more effective cooling.

BRIEF DESCRIPTION OF THE DRAWINGS

A full understanding of the invention can be gained from the following description of the preferred embodiments when read in conjunction with the accompanying drawings in which:

FIG. 4A is a side view of an embodiment in which symmetric localized expansions on one tube contact the expansions on an adjacent tube. FIG. 4B a side view of an embodiment with staggered localized expansions. FIG. 4C is a side view of tubes having furrels disposed symmetrically. FIG. 4D is a side view of tubes having furrels as staggered localized expansions. FIG. 4E is a side view a ridge embodiment in which the ridge is a helix. FIG. 4F is a side view of an embodiment with expanded regions of various widths, lengths and heights FIG. 4F' is a cross-sectional view taken along line 4F'—4F' on FIG. 4F. FIG. 4G is an isometric view of a symmetric ridge expansion. FIG. 4G' is a cross-sectional view taken along line 4G'—4G' on FIG. 4G. FIG. 4H is an isometric view of a non-symmetric ridge expansion. FIG. 4H' is a cross-sectional view taken along line 4H'—4H' on FIG. 4H.

DETAILED DESCRIPTION OF THE PREFERRED EMBODIMENT

Figure 1:
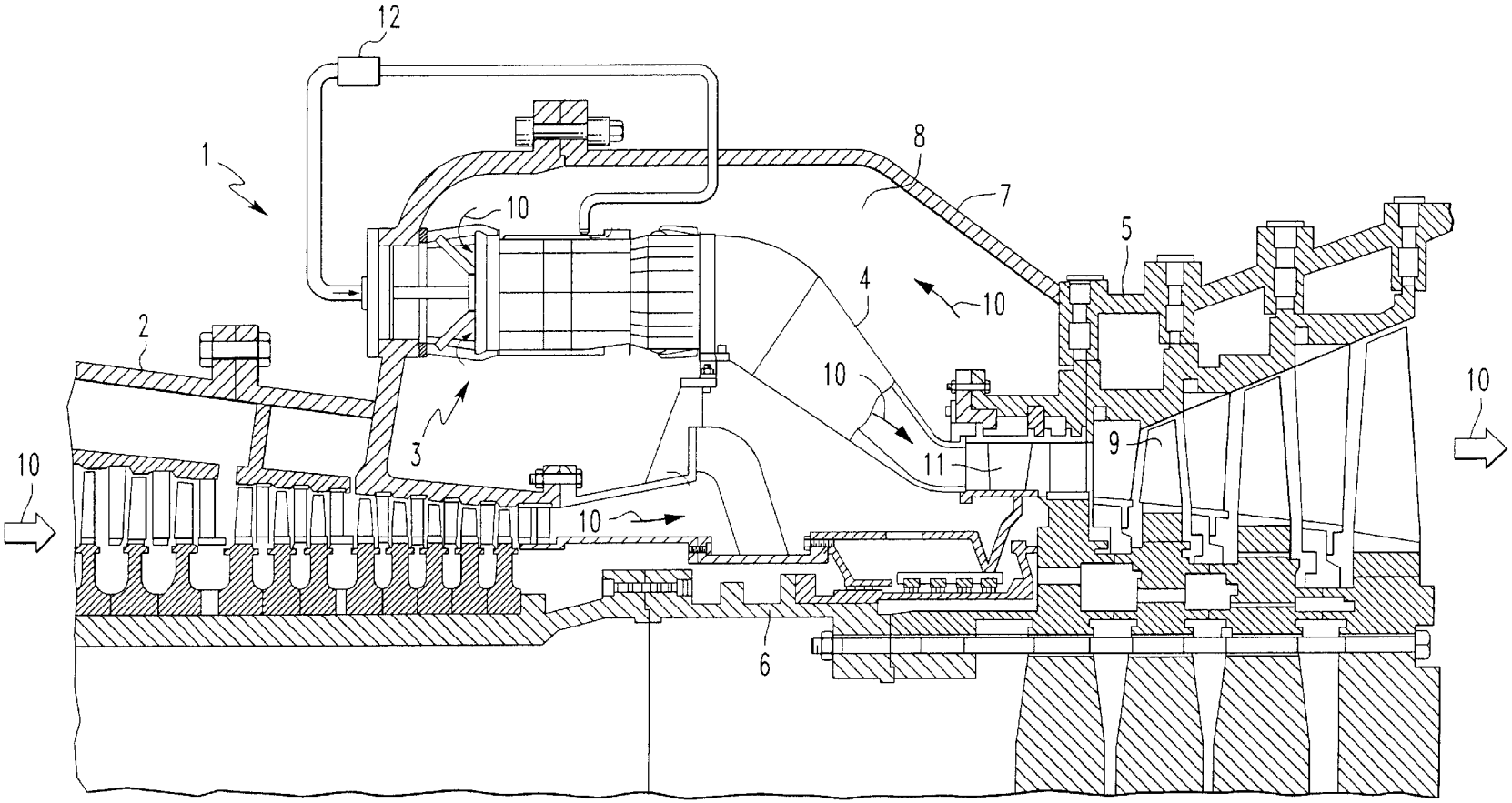
FIG. 1 is a cross sectional view of a combustion turbine.

As is well known in the art and shown in FIG. 1, a combustion turbine 1 includes a compressor assembly 2, a catalytic combustor assembly 3, a transition section 4, and a turbine assembly 5. A flow path 10 exists through the compressor 2, catalytic combustor assembly 3, transition section 4, and turbine assembly 5. The turbine assembly 5 may be mechanically coupled to the compressor assembly 2 by a central shaft 6. Typically, an outer casing 7 encloses a plurality of catalytic combustor assemblies 3 and transition sections 4. Outer casing 7 creates a compressed air plenum 8. The catalytic combustor assemblies 3 and transition sections 4 are disposed within the compressed air plenum 8. The catalytic combustor assemblies 3 are, preferably, disposed circumferentiality about the central shaft 6.

In operation, the compressor assembly 2 inducts ambient air and compresses it. The compressed air travels through the flow path 10 to the compressed air plenum 8 defined by casing 7. Compressed air within the compressed air plenum 8 enters a catalytic combustor assembly 3 where, as will be detailed below, the compressed air is mixed with a fuel and ignited to create a working gas. The working gas passes from the catalytic combustor assembly 3 through transition section 4 and into the turbine assembly 5. In the turbine assembly 5 the working gas is expanded through a series of rotatable blades 9 which are attached to shaft 6 and the stationary vanes 11. As the working gas passes through the turbine assembly 5, the blades 9 and shaft 6 rotate creating a mechanical force. The turbine assembly 5 can be coupled to a generator to produce electricity.

Figure 2:
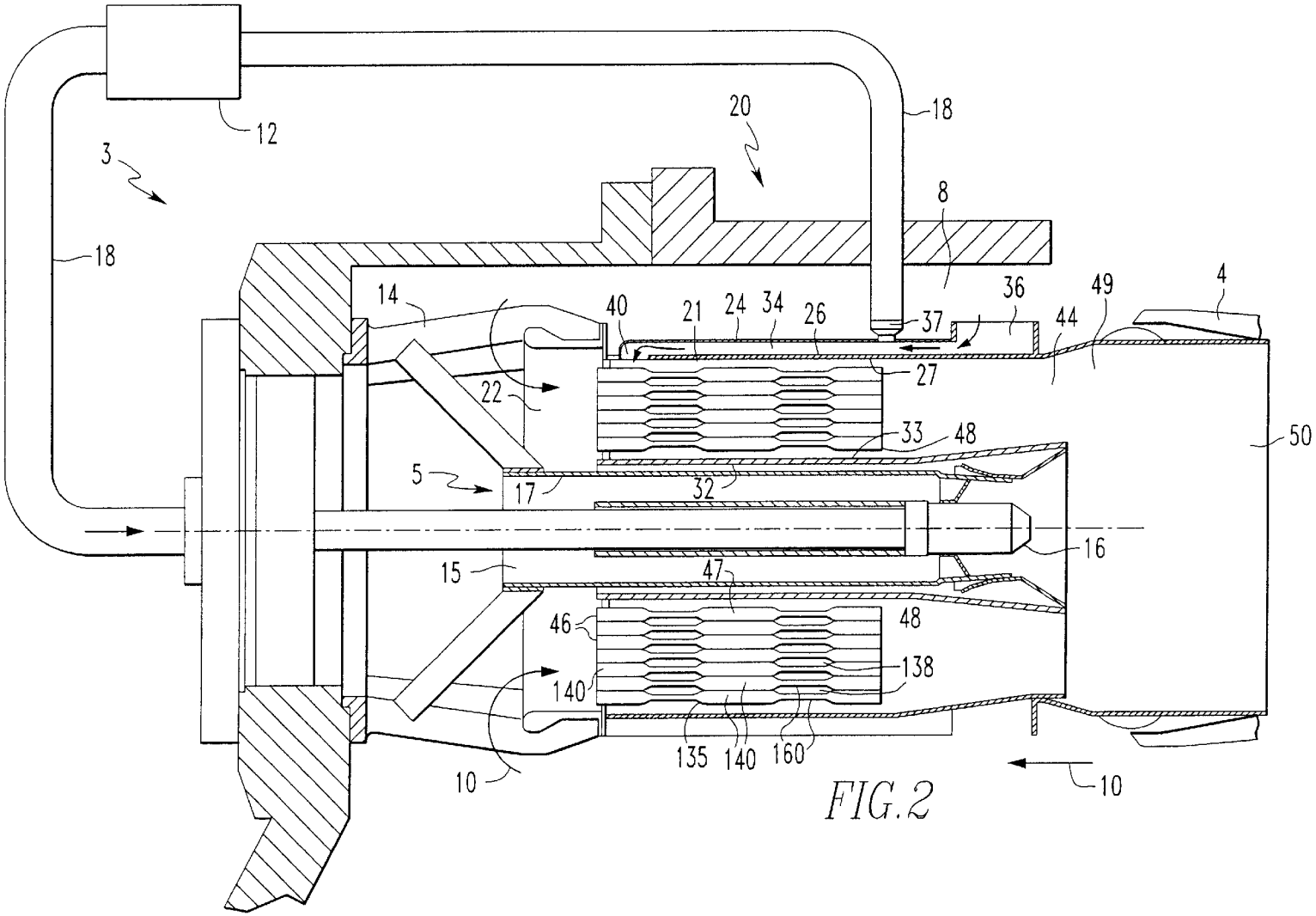
FIG. 2 is a partial cross sectional view of a combustor assembly shown on FIG. 1.

As shown in FIG. 2, the catalytic combustor assembly 3 includes a fuel source 12, a support frame 14, an igniter assembly 16, fuel tubes 18, and a catalytic reactor assembly 20. The catalytic reactor assembly 20 includes a catalytic core 21, an inlet nozzle 22, and an outer shell 24. The catalytic core 21 includes an inner shell 26, a tube sheet 28, a plurality of elongated tubes 30, and an inner wall 32. The catalytic core 21 is an elongated toroid which is disposed axially about the igniter assembly 16. Inner wall 32 is disposed adjacent to igniter assembly 16. Both the inner shell 26 and the inner wall 32 have interior surfaces 27, 33 respectively, located within the fuel/air plenum 38 (described below).

Outer shell 24 is in a spaced relation to inner shell 26 thereby creating a first plenum 34. The first plenum 34 has a compressed air inlet 36. The compressed air inlet 36 is in fluid communication with an air source, preferably the compressed air plenum 8. A fuel inlet 37 penetrates outer shell 24. Fuel inlet 37 is located downstream of air inlet 36. The fuel inlet 37 is in fluid communication with a fuel tube 18. The fuel tube 18 is in fluid communication with the fuel source 12.

A fuel/air plenum 38 is defined by tube sheet 28, inner shell 26, and inner wall 32. There is at least one fuel/air mixture inlet 40 on inner shell 26, which allows fluid communication between first plenum 34 and fuel/air plenum 38. The fuel/air plenum 38 has a downstream end 42, which is in fluid communication with a mixing chamber 44.

The plurality of tubes 30 each have a first end 46, a medial portion 47 and a second end 48. Each tube first end 46 extends through tube sheet 28 and is in fluid communication with inlet nozzle 22. The tube first ends 46, which are the upstream ends, are isolated from the fuel inlet 37. Thus, fuel cannot enter the first end 46 of the tubes 30. Each tube second end 48 is in fluid communication with mixing chamber 44. The tubes 30 have an interior surface 29 and an exterior surface 31. Each tube 30 has at least one expanded region 140, at least one narrow region 160 and at least one transition region 135. The narrow region 160 is typically the tube nominal diameter, however, as set forth below, the nominal tube diameter can be the expanded region 140 when the tube 30 is swaged to reduce the diameter in the narrow region 160. A catalytic material 30*a* may be bonded to the tube outer surface 31. Possible catalytic materials 30*a* include, but are not limited to, platinum, palladium, rhodium, iridium, osmium, ruthenium or other precious metal based combinations of elements with for example, and not limited to, cobalt, nickel or iron. Additionally, the catalytic material 30*a* may be bonded to the interior surface 27 of inner shell 26 and the interior surface 33 of inner wall 32. Thus, the surfaces within the fuel/air plenum 38 are, generally, coated with a catalytic material. In the preferred embodiment, the tubes 30 are tubular members. The tubes 30 may, however, be of any shape and may be constructed of members such as plates. The mixing chamber 44 has a downstream end 49, which is in fluid communication with a flame zone 60. Flame zone 60 is also in fluid communication with igniter assembly 16.

The igniter assembly 16 includes an outer wall 17, which defines an annular passage 15. The annular passage 15 is in fluid communication with compressed air plenum 8. The igniter assembly 16 is in further communication with a fuel tube 18. The igniter assembly 16 mixes compressed air from annular passage 15 and fuel from tube 18 and ignites the mixture initially with either a spark igniter or a igniter flame (not shown). The compressed air in annular passage 15 is swirled by vanes in annular passage 15. The angular momentum of the swirl causes a vortex flow with a low-pressure region along the centerline of the igniter assembly 16. Hot combustion products from flame zone 60 are re-circulated upstream along the low-pressure region and continuously ignite the incoming fuel air mixture to create a stabile pilot flame. Alternately, a spark igniter could be used instead of the pilot flame.

In operation, air from an air source, which is fed to the combustor, such as the compressed air plenum 8, is divided into at least two portions; a first portion, which is about 10 to 20 percent of the compressed air in the flow path 10, flows through air inlet 36 into the first plenum 34. A second portion of air, which is about 75 to 85 percent of the compressed air within the flow path 10, flows through inlet 22 into tubes 30. A third portion of air, which is about 5 percent of the compressed air in the flow path 10, may flow through the igniter assembly 16.

The first portion of air enters the first plenum 34. Within first plenum 34 the compressed air is mixed with a fuel that enters first plenum 34 through fuel inlet 37 thereby creating a fuel/air mixture. The fuel/air mixture is, preferably, fuel rich. The fuel rich fuel/air mixture passes through fuel/air inlet 40 into the fuel/air plenum 38. As the fuel rich fuel/air mixture, which is created in first plenum 34, enters the fuel/air plenum 38, the fuel/air mixture reacts with the catalytic material disposed on the tube outer surfaces 31, inner shell interior surface 27, and inner wall interior surface 33. The reacted fuel/air mixture exits the fuel/air plenum 38 into mixing chamber 44.

The second portion of air travels through inlet 22 and enters the tube first ends 46, traveling through tubes 30 to the tube second end 48. Air which has traveled through tubes 30 also enters mixing chamber 44. As the air travels through tubes 30, it absorbs heat created by the reaction of the fuel/air mixture with the catalytic material. Within mixing chamber 44, the reacted fuel/air mixture and compressed air is further mixed to create a fuel lean pre-ignition gas. The fuel lean pre-ignition gas exits the downstream end of the mixing chamber 49 and enters the flame zone 60. Within flame zone 60 the fuel lean pre-ignition gas is ignited by ignition assembly 16 thereby creating a working gas.

Figure 3:
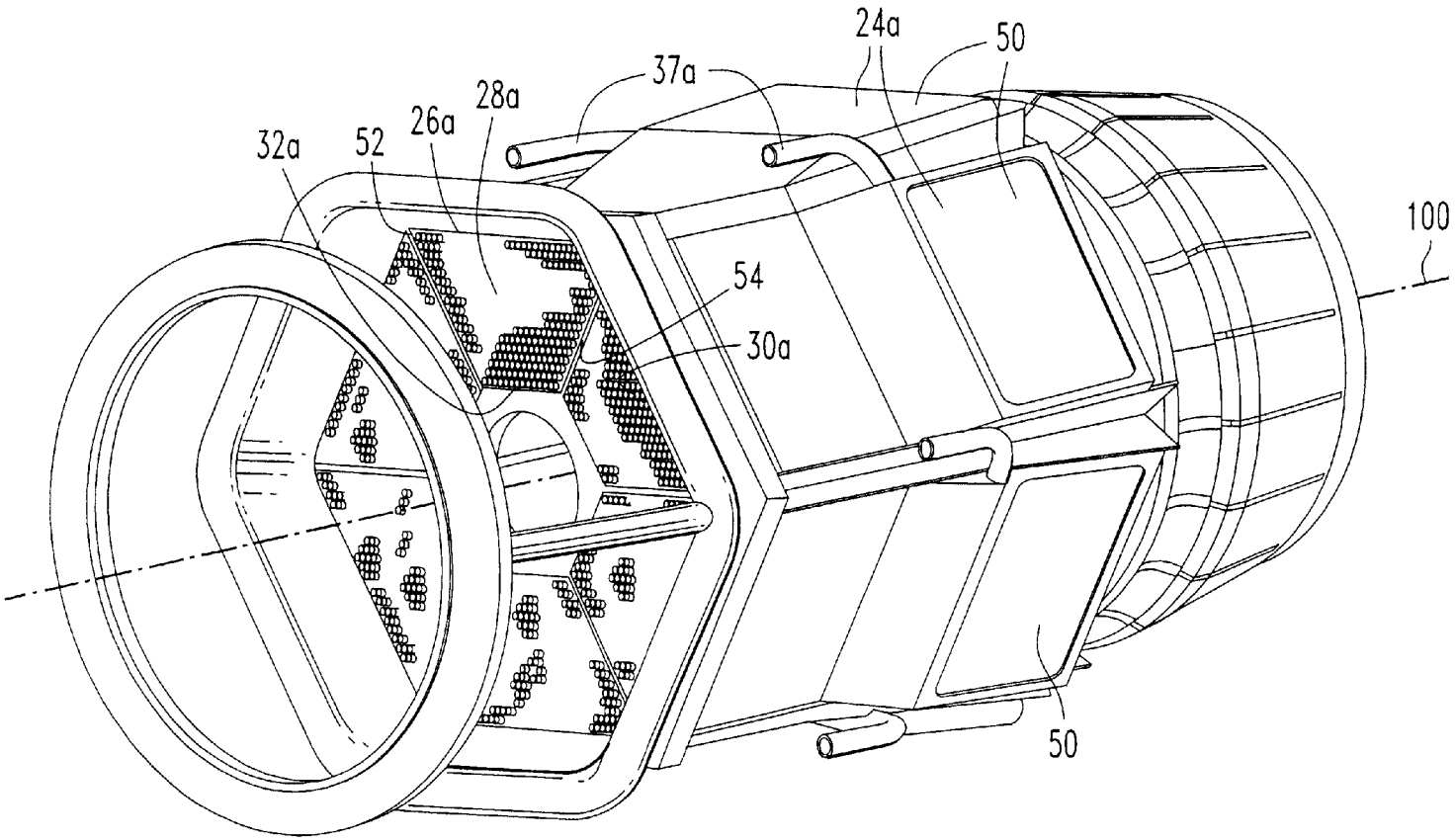
FIG. 3 is an isometric view showing modular catalytic cores disposed about a central axis.

As shown in FIG. 3, for ease of construction the catalytic reactor assembly may be separated into modules 50 that are disposed about a central axis 100. Each module 50 includes inner shell 26*a*, an inner wall 32*a* and sidewalls 52, 54. A plurality of tubes 30 are enclosed by inner shell 26*a*, inner wall 32*a* and sidewalls 52, 54. Each module 50 also has a tube sheet 28*a*, an outer shell 24*a* and a fuel inlet 37*a*. The rhomboid tube sheet 28*a* is coupled to the inner shell 26*a*, inner wall 32*a* and sidewalls 52, 54 of the upstream end of the module 50 by a fastening process (e.g. brazing). The tube sheet 28 is segmented, supporting a plurality of tubes 30 passing therethrough at the tubes 30 upstream ends 46. As shown, six modules 50 form a generally hexagonal shape about the central axis 100. Of course, any number of modules 50 of various shapes could be used.

The use of the catalytic material 30*a* allows a controlled reaction of the rich fuel/air mixture at a relatively low temperature such that almost no NOx is created in fuel/air plenum 38. The reaction of a portion of the fuel and air preheats the fuel/air mixture which aids in stabilizing the downstream flame in flame zone 60. When the fuel rich mixture is combined with the air, from the second portion of compressed air, a fuel lean pre-ignition gas is created. Because the pre-ignition gas is fuel-lean, the amount of NOx created by the combustor assembly 3 is reduced. Because compressed air only travels through the tubes 30, there is no chance that a fuel air mixture will ignite within the tubes 30. Thus, the tubes 30 will always be effective to remove heat from the fuel/air plenum 38 thereby extending the working life of the catalytic material 30*a*.

A vibration dampening device 120, shown in FIGS. 4A–4G, consists of at least one expanded region 140 and at least one narrow region 160 on one or more of the tubes 30. The narrow region 160, in most of the embodiments, is simply the unexpanded part of the tube or the nominal tube circumference. The expanded region 140 permits the plurality of closely oriented and parallel tubes 30 to remain in contact with one another, thus suppressing vibration. At least one expanded region 140 on each tube 30 is located on the tube medial portion 47.

Figure 4A:
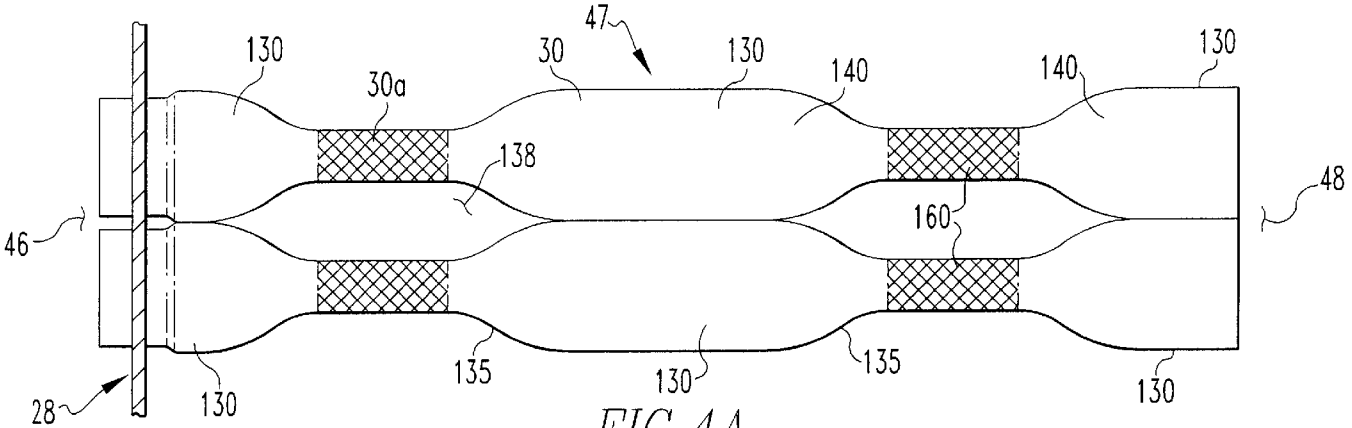
FIGS. 4A–4H are cross sectional, close-up views of the various embodiments of the invention. Each figure shows a different embodiment of two of the many cooling tubes within a catalytic combustor module.
Figure 4B:
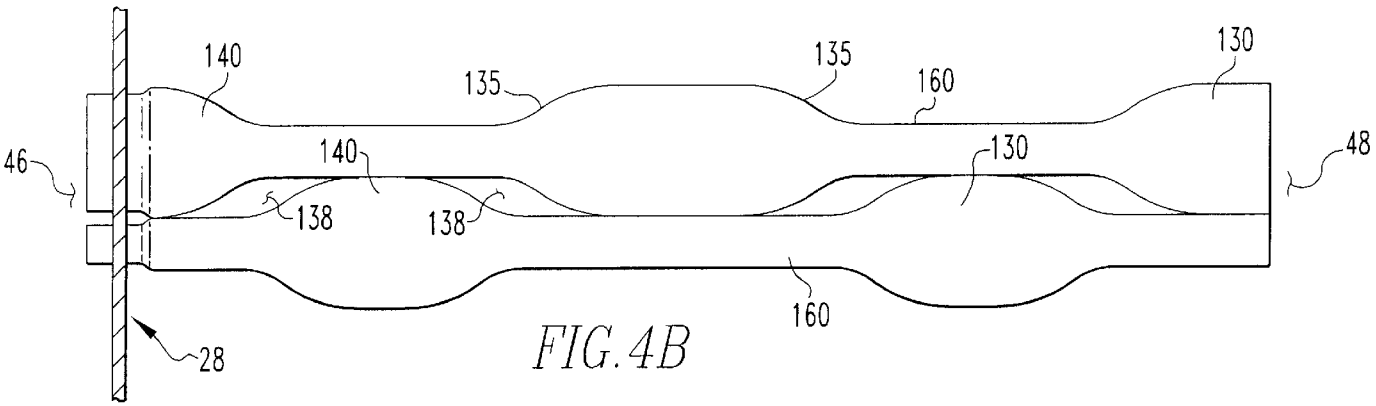
Figure 4C:
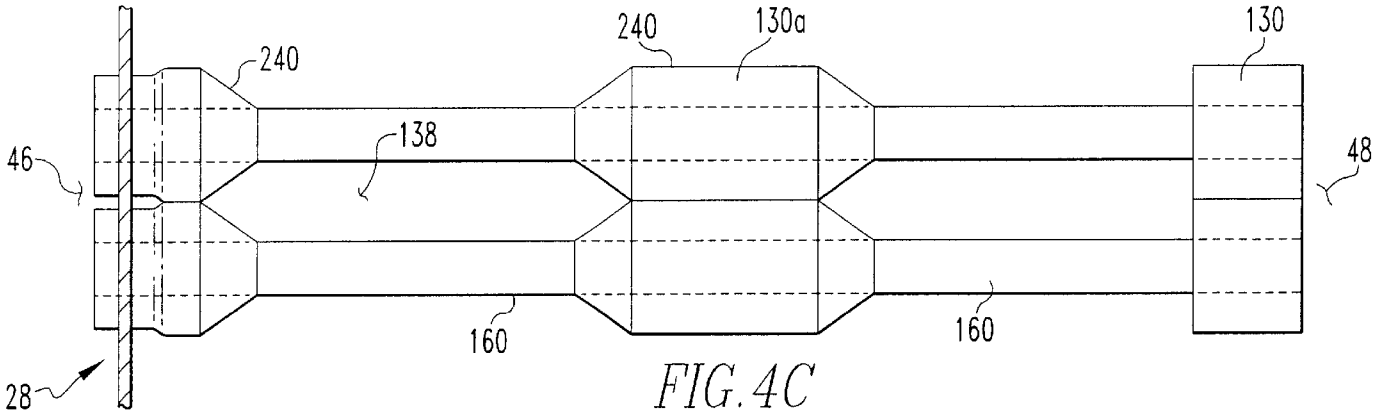

The expanded regions 140 may be formed numerous ways, including but not limited to, a localized expansion 130 of the nominal tube circumference with a gradual transition region 135 between the nominal tube circumference and the center of expansion, as shown in FIG. 4A; a sleeve or furrel 130*a* placed over the tube 30, thus enlarging the circumference as shown in FIG. 4C; or by using the nominal circumference as the expanded region 140 after machining or swaging the tube 30 to remove tube material and create narrow regions 160. The expanded region 140 does not extend the entire length of the tube 30 but there may be more than one expanded region 140 on each tube 30. As discussed in more detail below, the expanded region 140 may be symmetric 230 (FIG. 4G) along the tube length and/or around the tube circumference. Alternatively, the expansions could be non-symmetric 330, single-sided expansions 430 (FIG. 4H), or any combination thereof. The catalyst material 30*a* may cover the entire tube 30 or only the narrow regions 160, in which case the contacting expanded regions 140 are not coated.

As shown in FIG. 4A, in one embodiment, each tube 30 has an expanded region 140 at its first end 46, which is the upstream end of the tube 30, at least one expanded region 140 at the tube medial portion 47 and an expanded region 140 at it's second end 48, which is the downstream end of the tube 30. The upstream end 46 expanded region 140 help provide additional strength and support at the vibration susceptible tube sheet 28 junctions between the tubes 30 and the inner shell 26, inner wall 32, and side walls 52, 54. At the point where the tubes 30 pass through the tube sheet 28, the expanded regions 140 do not contact each other. That is, to allow the tube sheet 28 to be contiguous, the expanded regions 140 are spaced from each other at the tube sheet 28. Both expanded region 140 located at the first end and the second end 46, 48 also help to generate the desired flow path around the tubes 30 and the desired minimal pressure drop within the module 50.

In this embodiment, the expanded regions 140 are localized expansions 130 of the nominal outside tube circumference. The localized expansions 130 have at least one transition region 135, forming a gradual angle between the nominal outside tube circumference and the center of the expanded region 140. The gradual transition 135 and subtle expansion profile 130 are necessary to promote even flow through the module 50 and prevent an excessive pressure drop. An abrupt transition 135 and/or expansion 140 would likely create eddie currents which have damaging consequences such as back flash. The tubes 30 upstream ends 46 and downstream ends 48 are both expanded and each of the expanded regions 140 of one tube 30 contact the expanded regions 140 of the adjacent tubes 30. The catalyst 30*a* is only covering the unexpanded or narrow regions 160 of the tube 30. A flow path 138, corresponding to the fuel/air plenum 38, exists between the adjacent tubes 30. The flow path 138 is structured to avoid excessive pressure drop within, and promote uniform flow through the module 50.

In another embodiment, shown in FIG. 4B, the localized expansions 130 of one tube 30 are staggered with respect to the localized expansions 130 of at least one other, adjacent tube 30, so that the narrow region 160 of one tube contacts the localized expansion 130 of the adjacent tube 30. In this embodiment a different flow path 138 is created. As shown in FIG. 4B, the flow path 138 gaps are smaller but more numerous. However, the same beneficial uniform flow and minimal pressure drop can be achieved. Additionally, all of the tubes 30 do not have the same expansion pattern. As seen in FIG. 4B, every other tube does not have expansions 140 at the upstream 46 and downstream 48 ends. The end expansion 140 on one tube 30 supports the nominal tube circumference or narrow region 160, of the adjacent tube 30

Figure 4D:
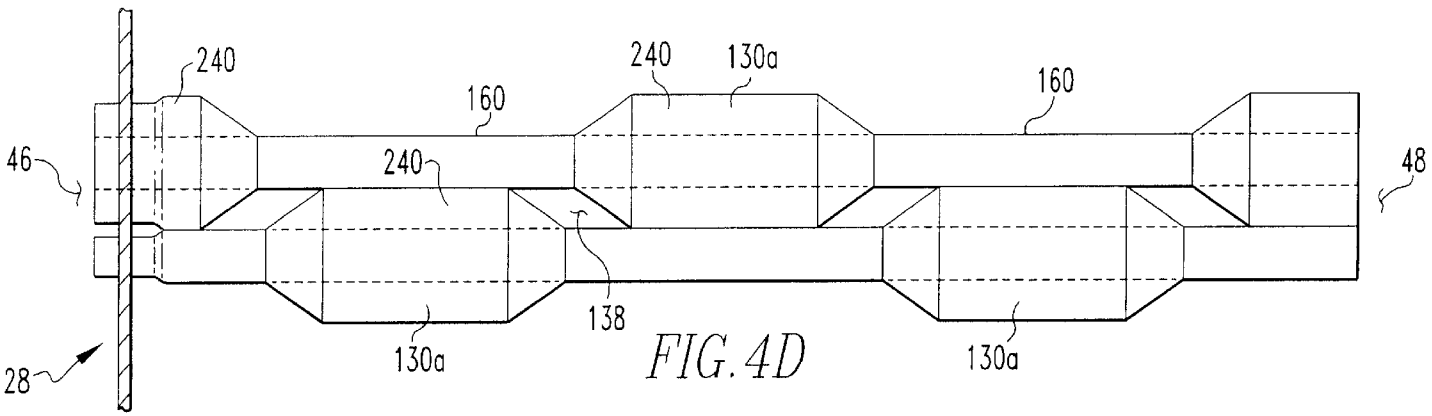
Figure 5A:
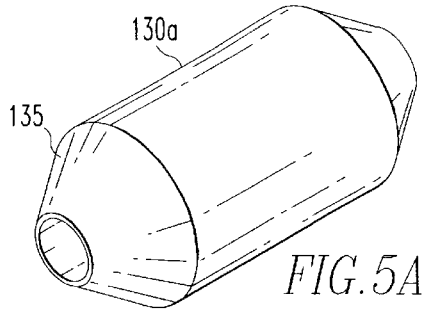
FIG. 5A shows an isometric view of a furrel that may be used as an expanded region of the tube.
Figure 5B:
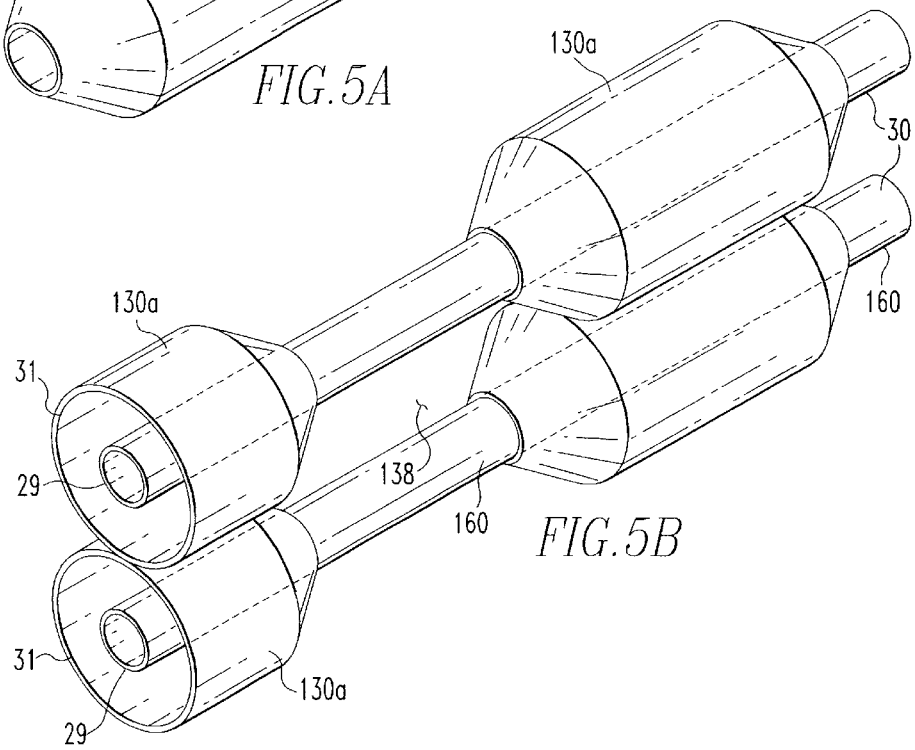
FIG. 5B shows an isometric view of furrels disposed on the tubes.
Figure 5C:
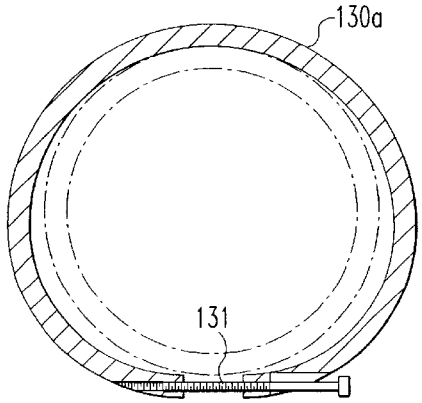
FIG. 5C shows an isometric view of an alternate furrel.
Figure 5D:
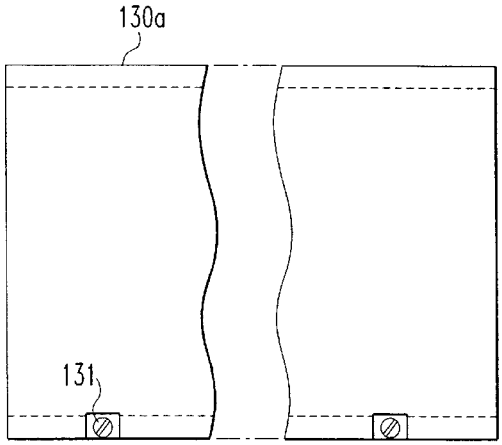
FIG. 5D is a side view of an alternate furrel.

In another embodiment, shown in FIGS. 4C, 4D, 5A, 5B, and 5C, a furrel 130*a* is disposed over the tube 30, thus creating an expanded region 240. A furrel 130*a* is a separate sleeve or piece of material having a greater outside diameter than the nominal diameter of the tube 30. As shown in FIG. 5A, the furrels 130*a* may be various lengths and shapes as long as a flow path 138 is formed between the expanded regions 240. The furrels 130*a* may be held in place on the tube 30 by any commonly used fastening means such as brazing, or a setscrew 131 (FIGS. 5C and 5D). The preferred furrel 130*a* shape, shown in FIG. 5A, is a sleeve tapered on both sides to form a gradual transition region 135 between the tube nominal circumference and the region with the greatest diameter on the furrel 130*a*. As shown in FIG. 5C, the furrel 130*a* may be formed without a transition. As before, the catalyst material 30*a* may cover the entire tube 30 or only the narrow regions 160, and the furrels 130*a* of one tube 30 may contact the furrels 130*a* of the adjacent tubes 30 as shown in FIG. 4C or they may be staggered as shown in FIG. 4D.

Figure 4E:
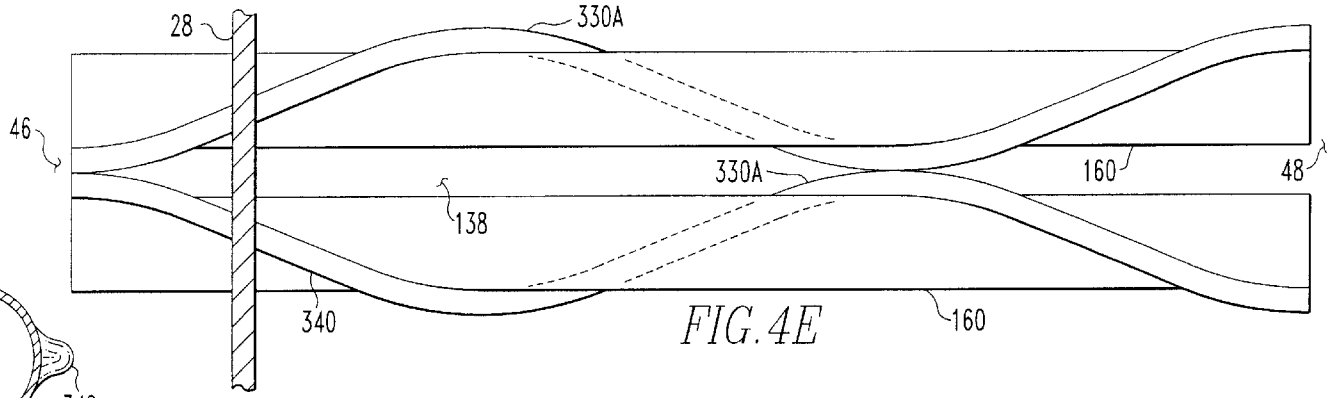
Figure 4F:
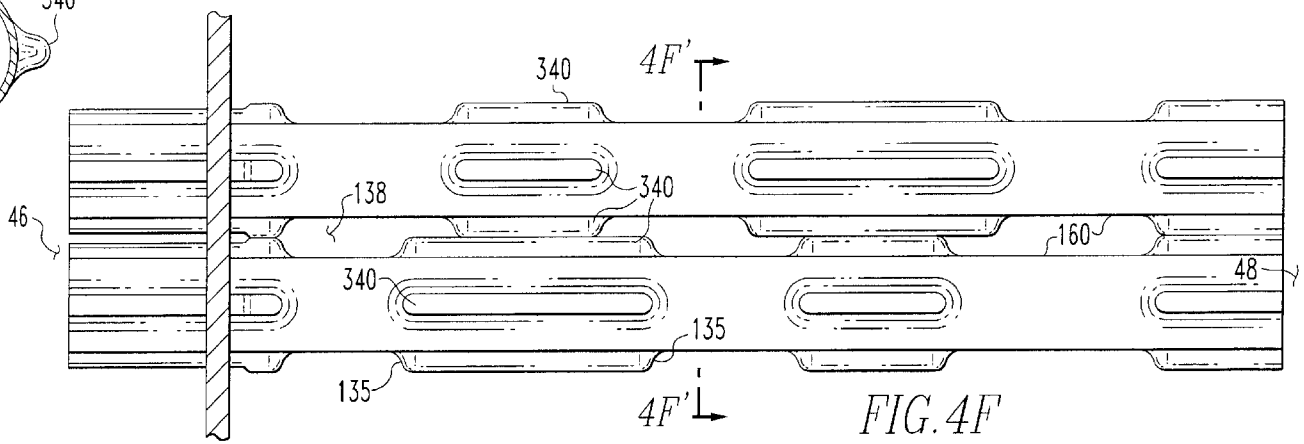
Figure 4F:
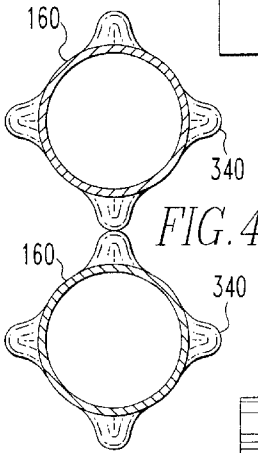
Figure 4G:
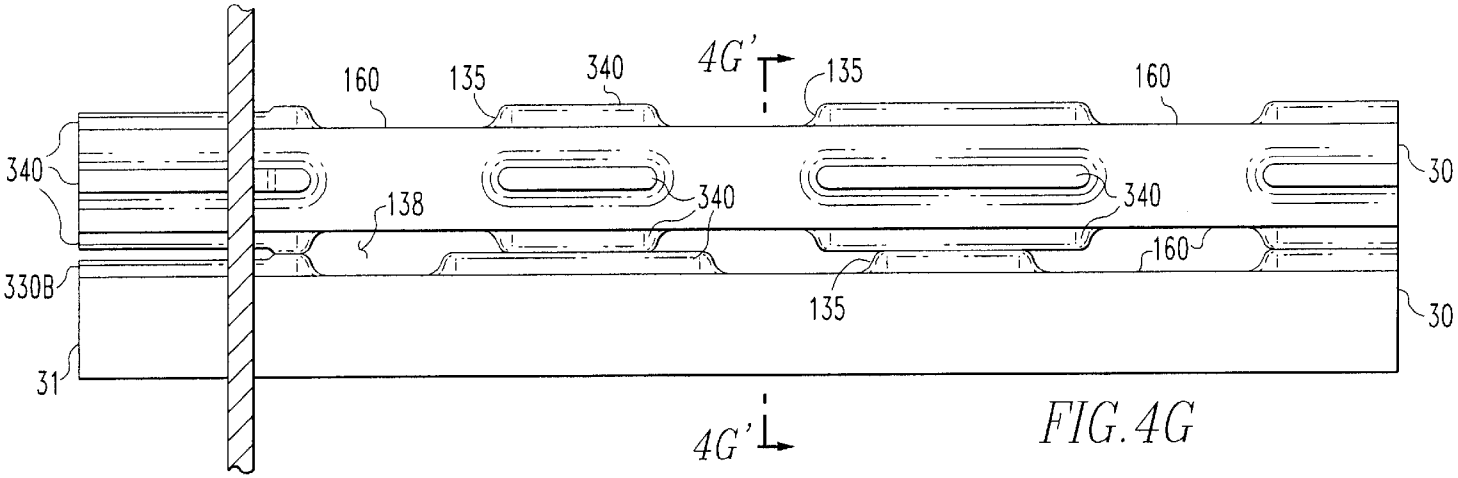
Figure 4G:
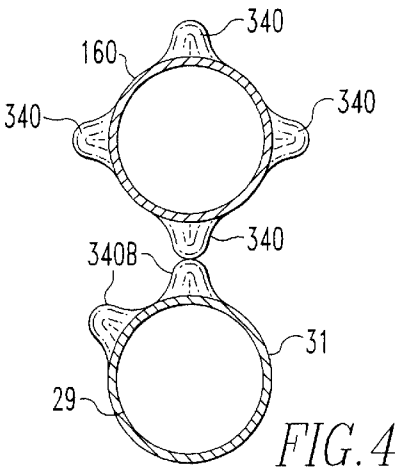
Figure 4H:
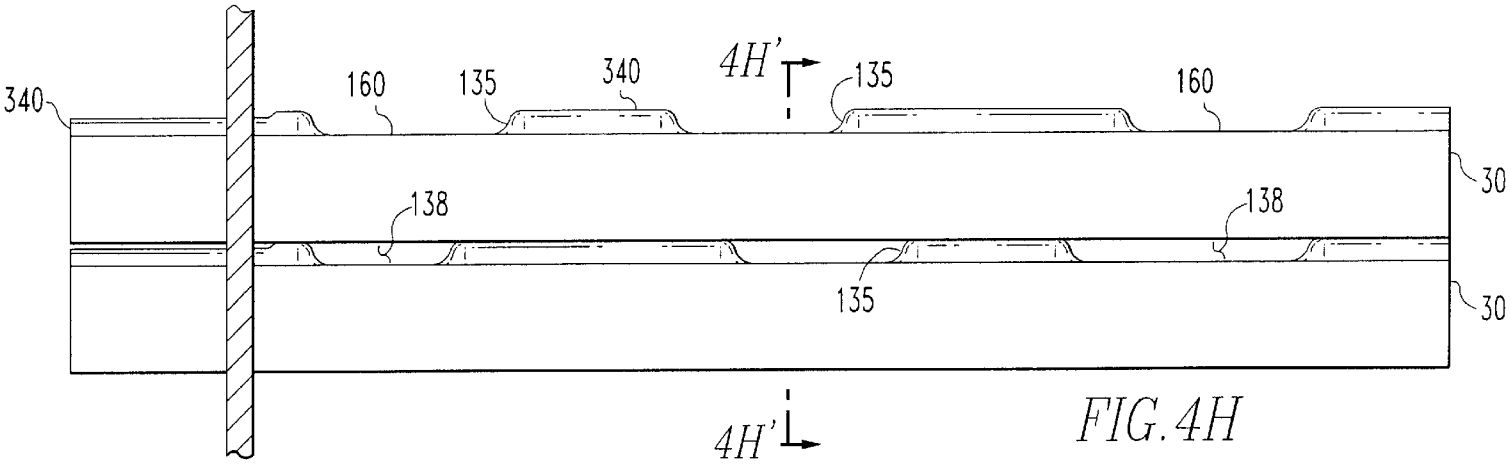
Figure 4H:
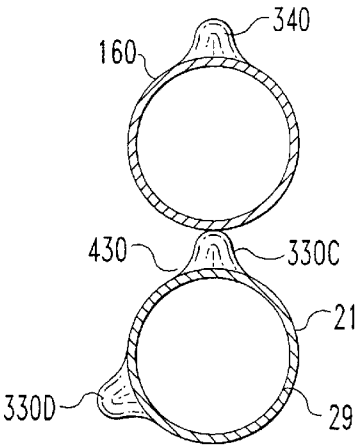

FIGS. 4E–4G show another embodiment in which the expanded regions 140 comprise a narrow ridge 340 expansion, extending longitudinally along the tube 30 and extending radially beyond the nominal diameter of the tube 30. As shown in FIG. 4E, the ridge 340 may form a helix 330A as it wraps around the tube 30. The helix 330A would touch the helix 330A of the adjacent tubes 30, thus providing support. Moreover, the helix shape 330A may enhance the flow path 138 around the tubes 30 and through the module 50 to improve catalytic reaction and achieve the best balance of fuel/air mixture combining with the cooling air exiting the tubes 30 at the downstream ends 48. Alternatively, as shown in FIGS. 4F, 4F', 4G, and 4H the ridge 330B may be generally straight, that is, extending in a direction parallel to, but spaced from, the tube axis. The ridges 330B may have various lengths, widths and heights. Additionally, the ridges 330B may be disposed at various locations around the circumference of the tubes 30. FIGS. 4G and 4G' illustrates symmetric ridges 330B, with the ridges 330B spaced generally 90 degrees apart around the circumference of the tube 30. FIGS. 4H and 4H' show non-symmetric ridges 330C wherein the ridge 330C is located on one side of the tube 30. FIG. 4H also shows varying the pattern of the expanded region 340 depending on the tube 30 location within the module 50. That is, ridge 330D is configured for a tube 30 located in a corner of a module 50, where for example the inner shell 26 and one of the side walls 52 connect. Various tube 30 size, shape, location and symmetry combinations could be utilized to benefit from the best amalgamation of tube 30 support, module 50 flow rate, and pressure drop within the module 50.

Figure 6:
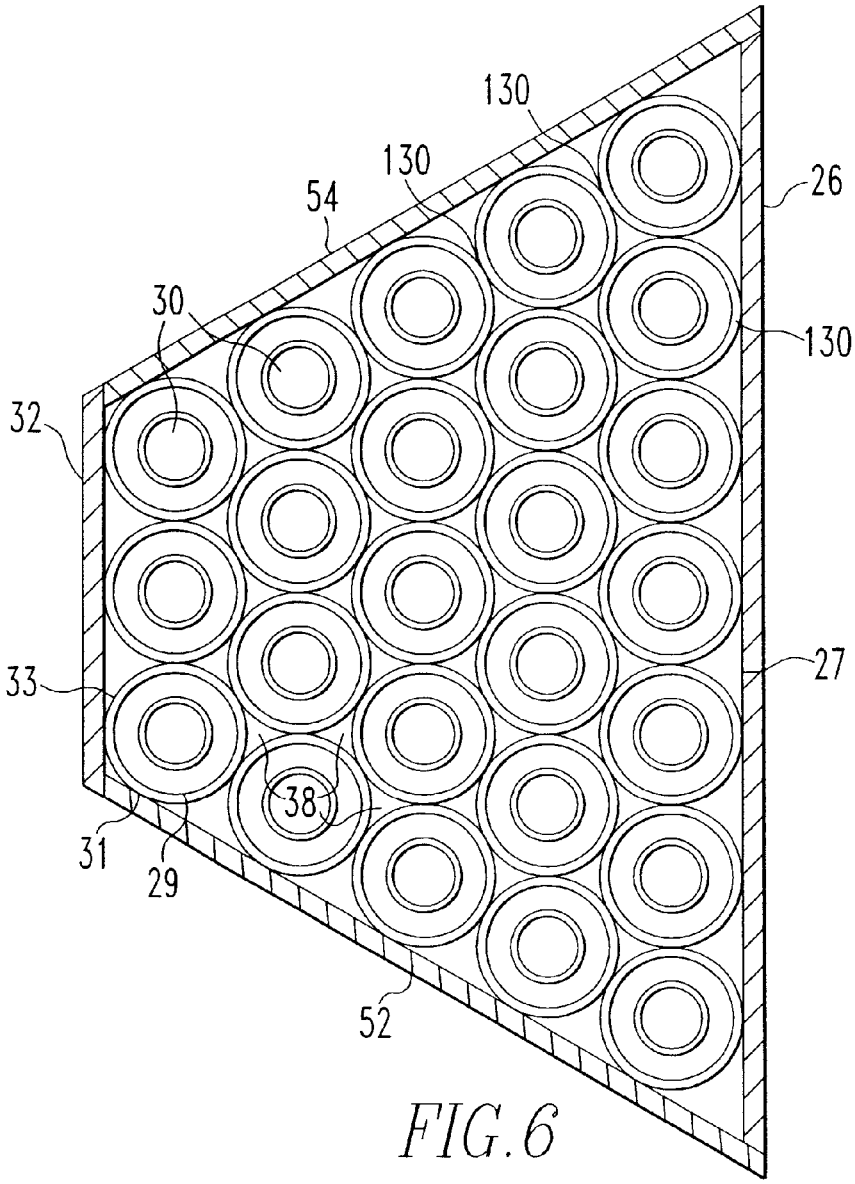
FIG. 6 is an end view of the invention looking along the longitudinal axis of one of the combustor tube modules.

As FIG. 6 shows the tubes 30 in a module 50. The expanded regions 140 contact each other where the tubes 30 are adjacent to other tubes 30, or contact the interior shell surface 27 or inner wall surface 33 where the tubes 30 are located adjacent to either the interior shell 26 or inner wall 32. The tubes 30 support each other and therefore reduce vibration. The fuel/air mixture flows past the expanded regions 140 through the plenum gaps constituting the flow path 138 and then combines with the cooling air exiting the tubes 30 at the tube downstream ends 48. FIG. 5 shows the medial portion of the module 50, looking down the longitudinal tube axis, of the embodiment in which the expansions 140 are localized tube expansions 130 of the nominal tube circumference.

While specific embodiments of the invention have been described in detail, it will be appreciated by those skilled in the art that various modifications and alternatives to those details could be developed in light of the overall teachings of the disclosure. For example, although the tubes 30 have been shown to be circular, various shapes could be used. For example the tubes could be oval or any other shape so long as the contacting surfaces preserve a flow path 138 for the fuel rich mixture to traverse and the benefit of minimal pressure drop is sustained. Accordingly, the particular arrangements disclosed, are meant to be illustrative only and not limiting as to the scope of invention which is to be given the full breadth of the claims appended and any and all equivalents thereof.

What is claimed is:

1. A dampening device for suppressing vibrations of a tube assembly in a catalytic combustor, said dampening device comprising:

a plurality of proximate, elongated, parallel tubes;

each tube of said plurality of tubes having a first end, a medial portion, a second end, at least one expanded region on said medial portion, and at least one narrow region; and each said expanded region being structured to contact at least one adjacent tube.

2. The dampening device of claim 1, wherein said at least one expanded regions are localized expansions of the tube circumference, said localized expansions having at least one gradual transition region between the nominal outside tube circumference and said expanded region.

3. The dampening device of claim 1 wherein said at least one expanded regions have a greater circumference than the nominal tube circumference.

4. The dampening device of claim 1 wherein:

said at least one expanded regions include a furrel disposed over said tube; and said furrel having a circumference greater than the nominal tube circumference.

5. The dampening device of claim 1 wherein said at least one expanded regions include at least one longitudinal ridge extending beyond the nominal tube circumference.

6. The dampening device of claim 5 wherein:

said at least one ridge includes a plurality of ridges;

said plurality of ridges being symmetric.

7. The dampening device of claim 5 wherein:

said at least one ridge includes a plurality of ridges;

said plurality of ridges being non-symmetric.

8. The dampening device of claim 1 wherein at least said at least one narrow region of said plurality of tubes is coated with a catalyst, said catalyst being selected from the group consisting of platinum, palladium, rhodium, iridium, osmium, ruthenium, cobalt, nickel and iron.

9. A tube module for a catalytic combustor comprising:

a plurality of proximate, elongated parallel cooling tubes;

said tubes each having a first end, a medial portion, and a second end;

a tube sheet;

a shell coupled to said tube sheet thereby defining a plenum;

said tubes coupled to said tube sheet with said first ends passing through said tube sheet, said tube medial portion extending through said plenum; and a dampening assembly for suppressing vibration of said plurality of tubes comprising at least one expanded region, disposed on said tube medial portion, and at least one narrow region on each tube, said at least one expanded region being structured to contact at least one adjacent tube.

10. The dampening device of claim 9, wherein said at least one expanded regions are localized expansions of the tube circumference, said localized expansions having at least one gradual transition region between the nominal outside tube circumference and said expanded region.

11. The dampening device of claim 9 wherein said at least one expanded region have a greater circumference than the nominal tube circumference.

12. The dampening device of claim 9 wherein:

said at least one expanded regions include a furrel disposed over said tube; and said furrel having a circumference greater than the nominal tube circumference.

13. The dampening device of claim 9 wherein said at least one expanded regions include at least one longitudinal ridge extending beyond the nominal tube circumference.

14. The tube module of claim 9 wherein said at least one narrow region of said plurality of tubes is coated with a catalyst, said catalyst being selected from the group consisting of platinum, palladium, rhodium, iridium, osmium, ruthenium, cobalt, nickel and iron.

15. A combustion turbine comprising:

a compressor assembly;

a turbine assembly;

a catalytic combustor assembly;

wherein said catalytic combustor assembly includes:

an air source;

a fuel delivery means;

a said catalytic combustor assembly in fluid communication with said air source and fuel delivery means, and having a fuel/air plenum which is coated with a catalytic material;

said fuel/air plenum having a plurality of proximate, parallel elongated cooling air tubes passing therethrough, said tubes each having a first end, a medial portion, and a second end, and a means for suppressing vibration of said plurality of cooling tubes having at least one expanded region, disposed on said tube medial portion, and at least one narrow region on each said tube, said at least one expanded region being structured to contact at least one adjacent tube;

said tube first ends being in fluid communication with said air source and isolated from said fuel delivery means; and a means for igniting a fuel/air mixture.

16. The dampening device of claim 15, wherein said at least one expanded regions are localized expansions of the tube circumference, said localized expansions having at least one gradual transition region between the nominal outside tube circumference and said expanded region.

17. The dampening device of claim 15 wherein said at least one expanded region have a greater circumference than the nominal tube circumference.

18. The dampening device of claim 15 wherein:

said at least one expanded region includes a furrel disposed over said tube; and said furrel having a circumference greater than the nominal tube circumference.

19. The dampening device of claim 15 wherein said at least one expanded regions include at least one longitudinal ridge extending beyond the nominal tube circumference.

20. The combustion turbine of claim 15 wherein at least said at least one narrow region of said plurality of tubes is coated with a catalyst, said catalyst being selected from the group consisting of platinum, palladium, rhodium, iridium, osmium, ruthenium, cobalt, nickel and iron.

* * * * *